US006622538B2

(12) United States Patent
Prunbauer et al.

(10) Patent No.: US 6,622,538 B2
(45) Date of Patent: Sep. 23, 2003

(54) CYLINDER LOCK WITH TUMBLER PLATES

(75) Inventors: Kurt Prunbauer, Herzogenburg (AT); Reinhard Amon, Straning (AT)

(73) Assignee: Evva-Werk Spezialerzeugung von Zylinder-und Sicherheitsschlossern Gesellschaft m.b.H. & Co. KG, Vienna (AT)

( * ) Notice: Subject to any disclaimer, the term of this patent is extended or adjusted under 35 U.S.C. 154(b) by 0 days.

(21) Appl. No.: 10/229,388

(22) Filed: Aug. 27, 2002

(65) Prior Publication Data

US 2003/0041637 A1 Mar. 6, 2003

(30) Foreign Application Priority Data

Aug. 28, 2001 (AT) ..... 1359/01
Oct. 24, 2001 (AT) ..... 1692/01

(51) Int. Cl.[7] ..... E05B 29/04
(52) U.S. Cl. ..... 70/492; 70/34; 70/366; 70/386
(58) Field of Search ..... 70/32, 34, 365, 70/366, 492, 495, 377, 392, 386, DIG. 1, DIG. 2

(56) References Cited

U.S. PATENT DOCUMENTS 1,592,696 A * 7/1926 Heyer
1,823,411 A * 9/1931 Schori
4,012,931 A * 3/1977 Harunari ..... 70/386 X
4,044,578 A * 8/1977 Guiraud ..... 70/366
4,400,955 A * 8/1983 Di Motta ..... 70/339
4,418,555 A * 12/1983 Uyeda ..... 70/366
4,667,493 A * 5/1987 Takahashi ..... 70/366
4,683,739 A * 8/1987 Hughes ..... 70/378 X

FOREIGN PATENT DOCUMENTS

FR 566170 * 11/1923 ..... 70/366

* cited by examiner

*Primary Examiner*—Lloyd A. Gall
(74) *Attorney, Agent, or Firm*—Hubert Dubno; Andrew Wilford

(57) ABSTRACT

A lock core rotatable in a housing is formed with an axially extending key passage, transverse guide slots, and an axially inwardly open bore. A bolt displaceable in the bore between a locked position and a unlocked position has radially open grooves aligned with the slots in the locked position. The inner bolt end can directly engage in an inwardly open seat formed in the housing or with a ball engageable in such a seat to lock the core in the housing. Tumbler plates in the slots are formed with control edges and holes alignable with the bore in a freeing position. The plates are displaceable into blocking positions with the holes offset at least partially from the bore and engaging in the respective grooves. A key has a plurality of respective bit notches engageable with the control edges on engagement of the key in the passage.

12 Claims, 7 Drawing Sheets

CYLINDER LOCK WITH TUMBLER PLATES

FIELD OF THE INVENTION

The present invention relates to a cylinder lock. More particularly this invention concerns such a lock having tumbler plates and a mechanical key.

BACKGROUND OF THE INVENTION

A standard cylinder lock has a stationary cylinder housing and a core rotatable about an axis in the housing and formed with an axially extending key passage and a plurality of transverse guide slots. Respective tumbler plates transversely displaceable in the slots are each formed with a control edge exposed in the passage. Each plate is displaceable by a key from a freeing position to a blocking position that prevents rotation of the core in the housing. The key has a plurality of respective bits engageable with the control edges on axial engagement of the key in the passage. When the key is fully inserted in the passage all the plates are in the freeing position and the core can rotate in the housing.

Since much of the mechanism is actually held in the core, such a lock can be made very compact. Still the security offered is modest, particularly against picking.

OBJECTS OF THE INVENTION

It is therefore an object of the present invention to provide an improved cylinder lock.

Another object is the provision of such an improved cylinder lock which overcomes the above-given disadvantages, that is which is very secure and hard to pick.

SUMMARY OF THE INVENTION

A lock has according to the invention a stationary cylinder housing and a core rotatable about an axis in the housing and formed with an axially extending key passage, a plurality of transverse guide slots, and an axially inwardly open bore. A bolt is axially displaceable in the bore between a locked position and a retracted unlocked position and has a plurality of radially open grooves aligned transversely with the slots in the locked position of the bolt. The end of the bolt or a latch member, e.g. a ball, actuated by the bolt end can be pushed out in the locked position into a seat in the housing to rotationally fix the core in the housing. Respective tumbler plates transversely displaceable in the slots are each formed with a control edge exposed in the passage and a hole alignable with the bore in a freeing position of the respective plate. Each plate is displaceable from the freeing position to a blocking position with its hole offset at least partially from the bore and engaging in the respective groove to block axial movement of the bolt from the locked position. A key has a plurality of respective bit notches engageable with the control edges on axial engagement of the key in the passage. The control edges and the respective bit notches are positioned such that when the key is fully inserted in the passage all the plates are in the freeing position and the bolt can shift axially between its locked and unlocked positions.

Thus with this system the bolt can only retract and free the core to rotate when all of the tumbler plates are shifted into the freeing position. It is not possible to work the tumblers back one at a time with a flat pick as in the prior-art locks, and there is no way to get at the bolt from outside the lock.

According to the invention the bolt has an inner end that projects from the core housing in the locked position. The housing is formed with a seat complementarily engaging the inner end in the locked position.

The housing can be formed with one or more radially inwardly open seats and each plate is formed with a radially outwardly projecting tab engaged in the seat in the blocking position. Thus the plates help arrest the core in the housing.

Each plate is formed according to the invention with a guide formation engaging a complementary guide formation of the respective slot for transverse sliding of the tabs between the freeing and blocking positions. Alternately, a pivot is provided for rocking of the tabs between the freeing and blocking positions. In either case, respective springs urge the control edges toward the passage and, when a key is therein, into engagement with the key.

The bit notches in accordance with the invention end generally at a symmetry plane of the key. Furthermore they have flanks forming acute angles with the respective faces of the key so that, as the key is inserted in the passage, the control edges slide down into and then up out of the bit notches. In addition the key has a pointed front end cammingly engageable with the control edges on insertion of the key into the passage. The notches are provided in two sets staggered on opposite faces of the key. For ease of use the key is symmetrical to a plane and formed with two identical sets of notches for use of the key upside down.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
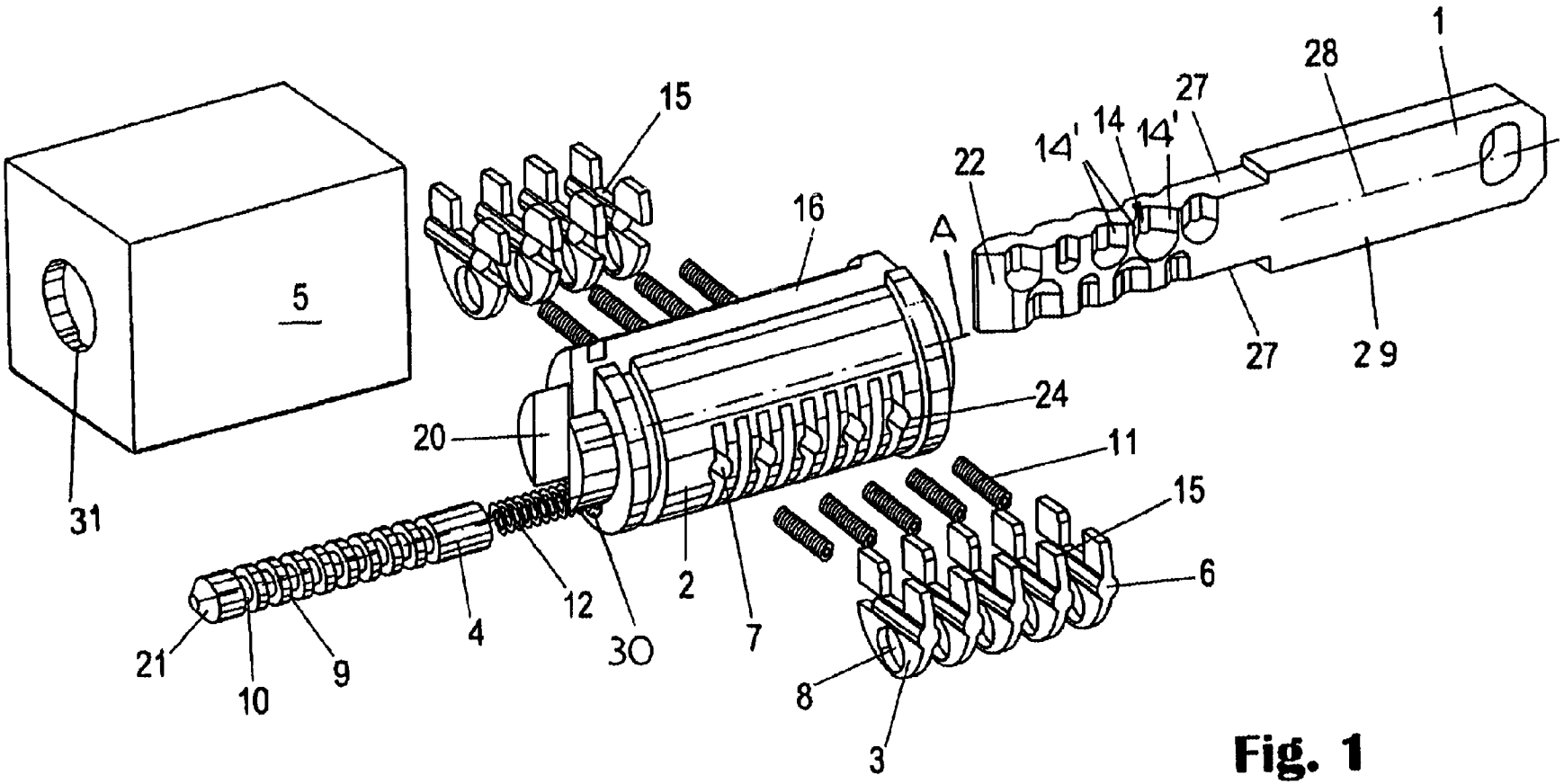
FIG. 1 is an exploded view of the lock according to the invention.
Figure 2:
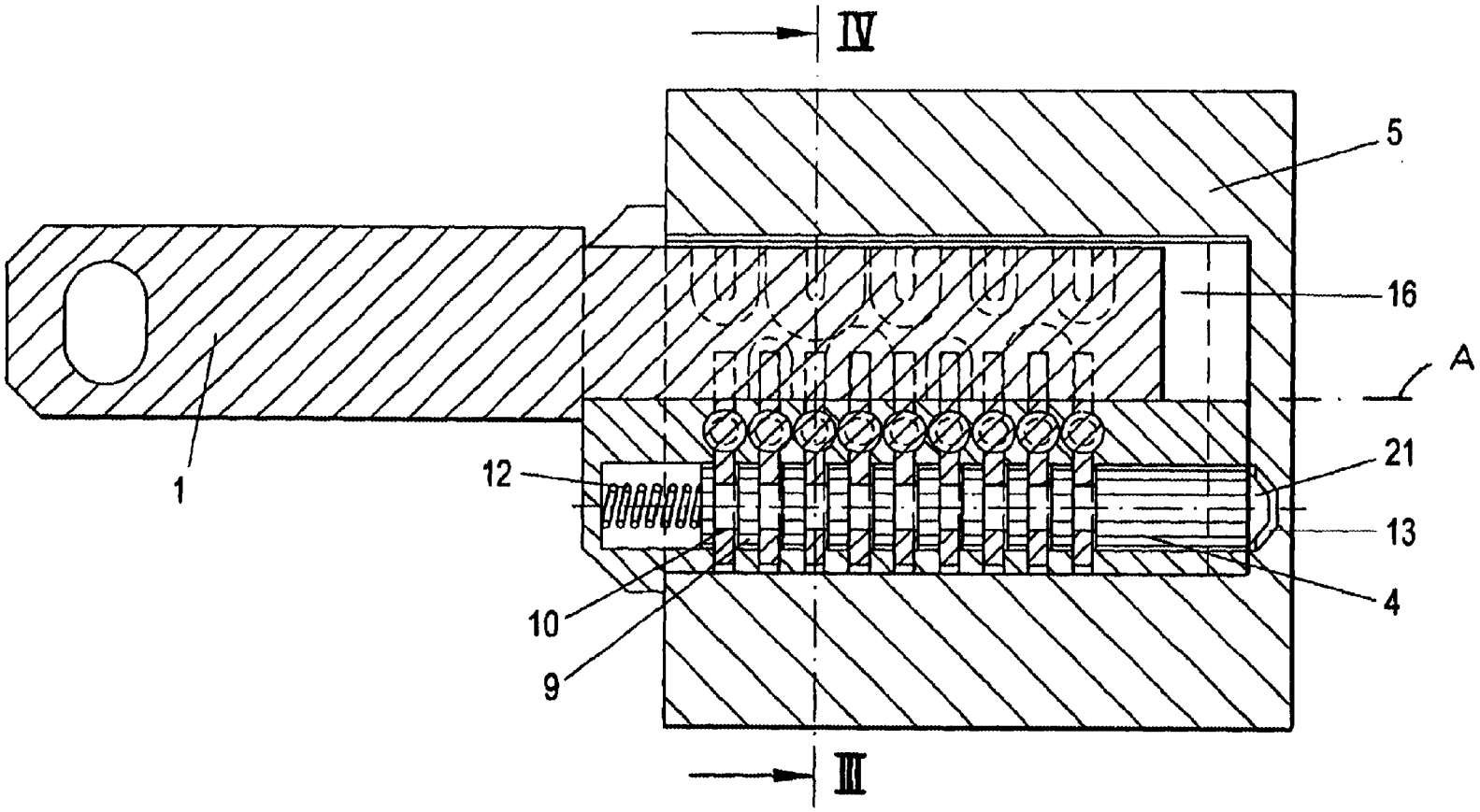
FIG. 2 is an axial section through the lock taken along line II—II of FIG. 4.
Figure 3:
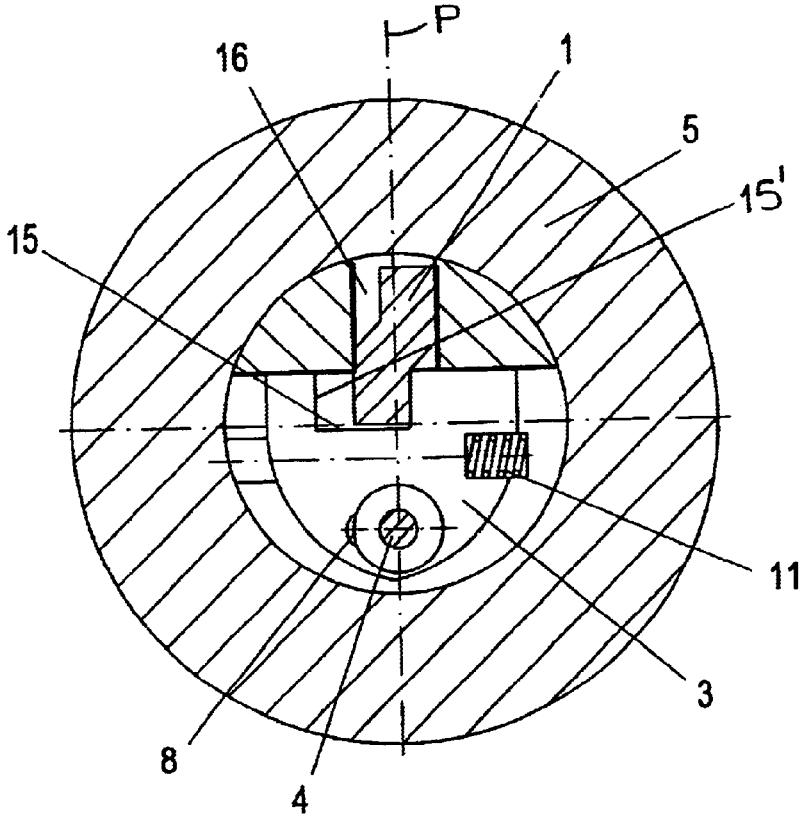
FIGS. 3 and 4 are sections taken along line III–IV of FIG. 2 showing the lock in unlocked and locked positions.
Figure 4:
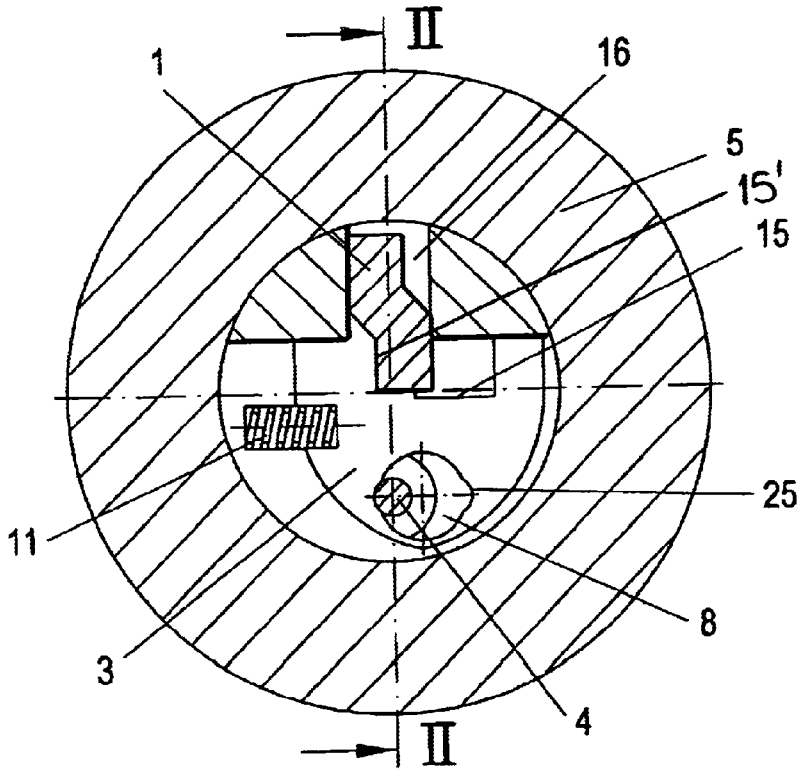

As seen in FIGS. 1 through 4, a lock according to the invention has a basically cylindrical core 2 centered on an axis A and rotatable thereabout in a bore 31 of a housing 5. The core 2 has a rear end formed with a pair of coupling tabs 20 intended for connection to a locking mechanism, for instance a bolt-actuating lever. It is also formed centered on an axial plane P with an axially extending and radially open rectangular-section slot 16 adapted to receive a key 1 of complementary section, and with ten crosswise guide slots 7 each formed with a central guide groove or enlargement 24. Finally the core 2 is formed on the plane P bisecting the groove 15 with an axially rearwardly open cylindrical hole 30 that aligns as shown in FIG. 2, in a locked and unturned position of the lock, with an axially forwardly open bluntly conical pocket or seat 13 in the housing 5.

The guide slots 7 receives respective tumbler plates 3 formed centrally with widenings or guide ridges 6 that fit complementarily with the grooves 24 of the respective slots 7 so that the plates 3 can slide freely in respective parallel planes perpendicular to the plane P. A spring 11 urges each plate 3 into an outer position shown in FIG. 4. The upper edge of each plate 3 is straight and formed with an upwardly open notch 15 through which the key 11 can slide when in the slot 16 and having a control edge 15'. Below each notch 15 each plate 7 is formed with a circular hole 8 having one side formed with a small-diameter enlargement 25.

The key 1 is of basically rectangular section, is symmetrical to a plane 28, and is flanked by a pair of parallel flat edges 27, one of which normally rides in the floor of the groove 15 when the key 1 is inserted in the lock. The blade of the key is formed on each side with five bit notches 14 having flanks 14' extending at angles of 45° or better to the respective flat face 29 of the key 1. The tip of the key 1 is chamfered at 22 so that, as the key 1 is inserted into the passage 16, it pushes the tumblers 3 to the side, against their springs 11, and as it moves all the way in these tumblers 3 bear with their control edges 15' on the key face 29, riding up and down the angled flanks 14' of the bit notches 14 until, when the key 1 is fully inserted, each edge 15' settles at the base of a respective notch 14. The depths of the notches 14 are such relative to the positions of the control edges 15' that when a properly bitted key 1 is fitted all the way into the core 2, the tumbler plates 3 are positioned with their holes 8 coaxial and centered on the plane P. The key 1 is double-bitted and symmetrical to the plane 28 so that it works upside down.

The bore 30 of the core 2 slidably receives a cylindrical lock bolt or pin 4 formed with ten axially spaced and radially outwardly open square-sided grooves 10 alternating with full-diameter cylindrical lands 9. The lands 9 have an outside diameter slightly smaller than that of the holes 8 and the radius of curvature at the floors of the grooves 10 generally corresponds to that of the hole enlargements 25. A spring 20 is braced between a front end of the bolt 4 and the core 2 and a rear end 21 of the bolt 4 is of blunt conical shape and adapted to fit complementarily in the seat 13 of the housing 5 (FIG. 2). When the bolt 4 engages in the seat 13, the core 2 cannot rotate in the housing 5.

When a properly bitted key 1 is fitted to the core 2 so as to set the tumbler plates 3 with their holes 8 coaxial on the plane P, the bolt 4 can move axially in the hole 30 and into and out of the seat 13. This allows the core 2 to be rotated about its axis A in the housing 5 since such rotation cams the bolt 4 axially into the bore 30 and out of the seat 13.

If, however, any one of the tumblers 3 is not shifted against its spring 11 so that, instead, its enlarged portion 25 engages in the base of the respective groove 10, the bolt 4 will not be able to pull out of the seat 13 because the one tumbler 3 will fit in the groove 10 and block any axial movement. This will lock the core 2 in the housing 5 and prevent it from rotating.

Figure 5:
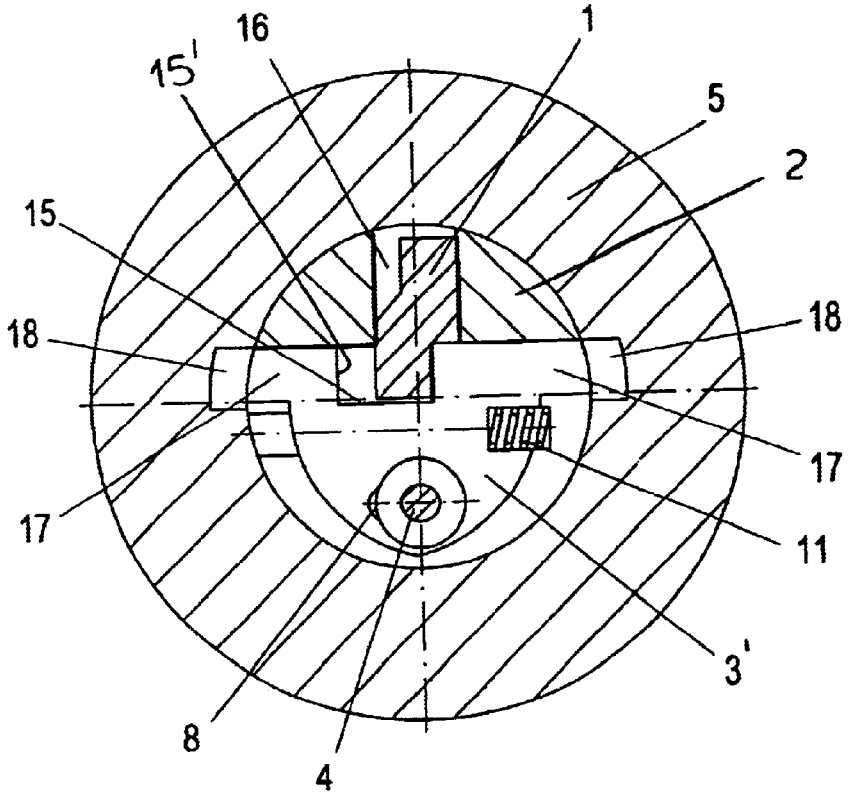
FIGS. 5 and 6 are views like FIGS. 3 and 4 of another lock in accordance with the invention.
Figure 6:
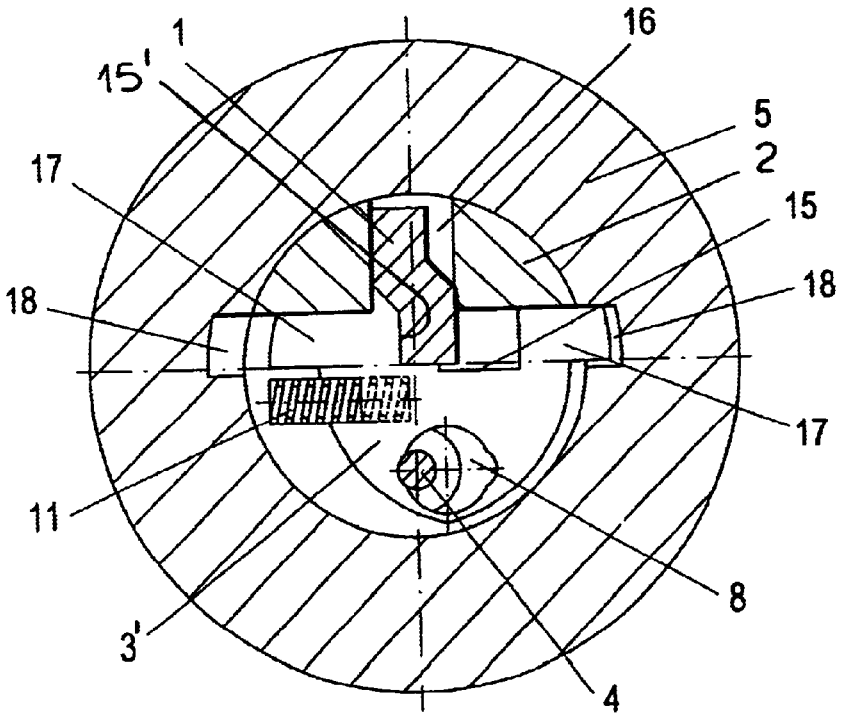

FIGS. 5 and 6 show a system similar to that of FIGS. 1 through 4, except that the tumbler plates 3' are provided with diametrally oppositely extending tabs or ears 17 that can project into radially inwardly open and axially extending grooves 18 formed in the housing 5. Thus in the blocking position as shown in FIG. 6 the ears 17 physically prevent the core 2 from rotating in the housing 5 so that they work with the bolt 4. In the freeing position of FIG. 5 the tabs 17 allow rotation of the core 2.

Figure 7:
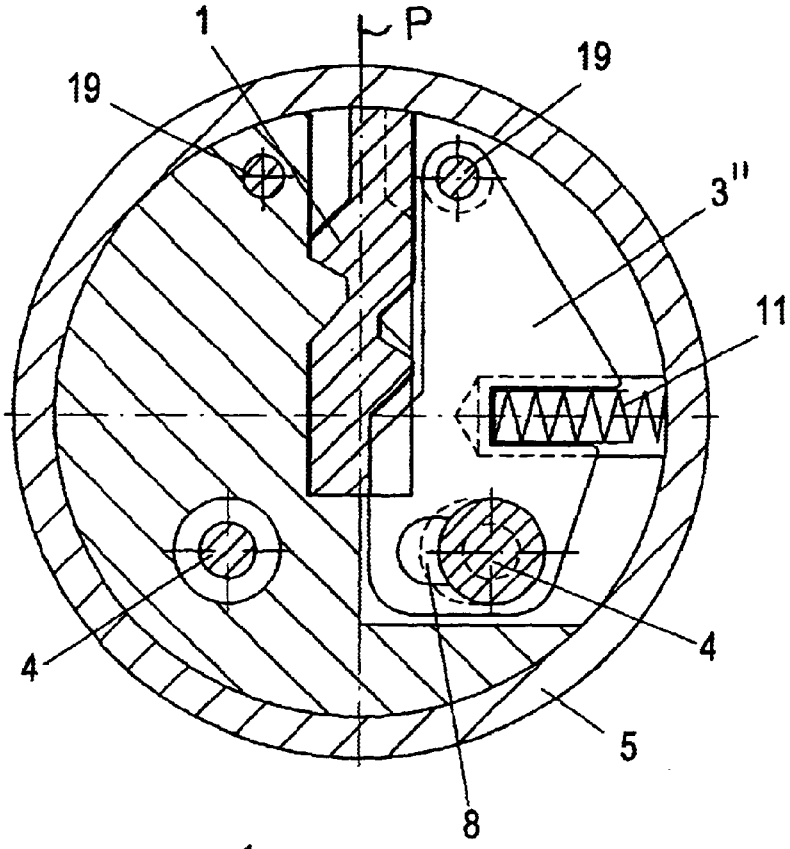
FIGS. 7 and 8 are views also like FIGS. 3 and 4 of yet another lock according to the invention.
Figure 8:
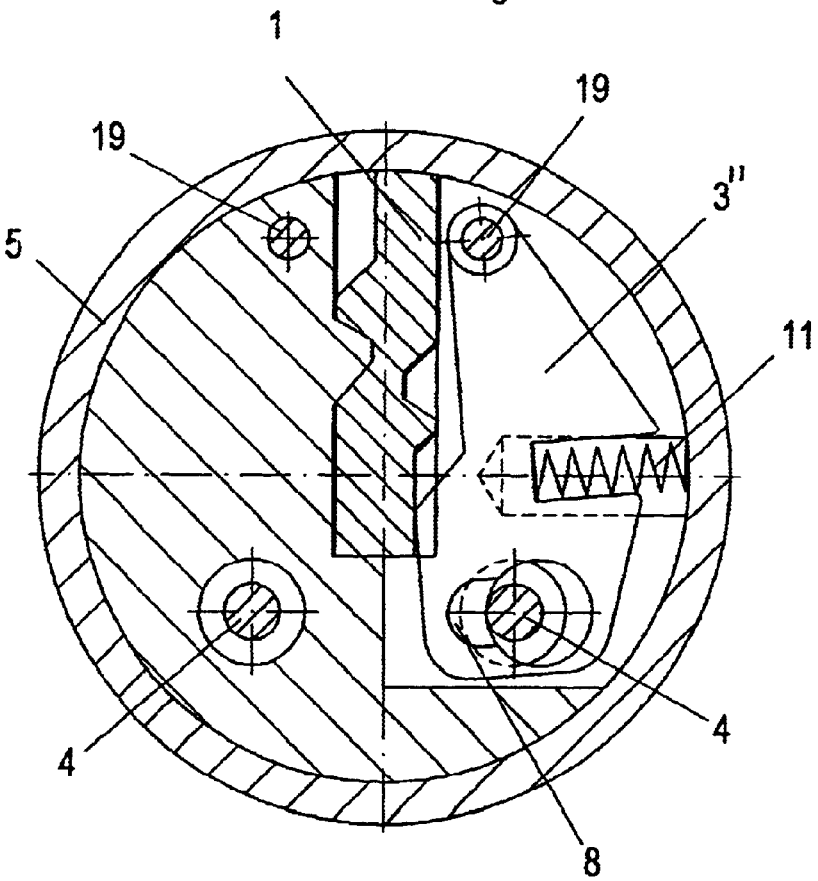
Figure 9:
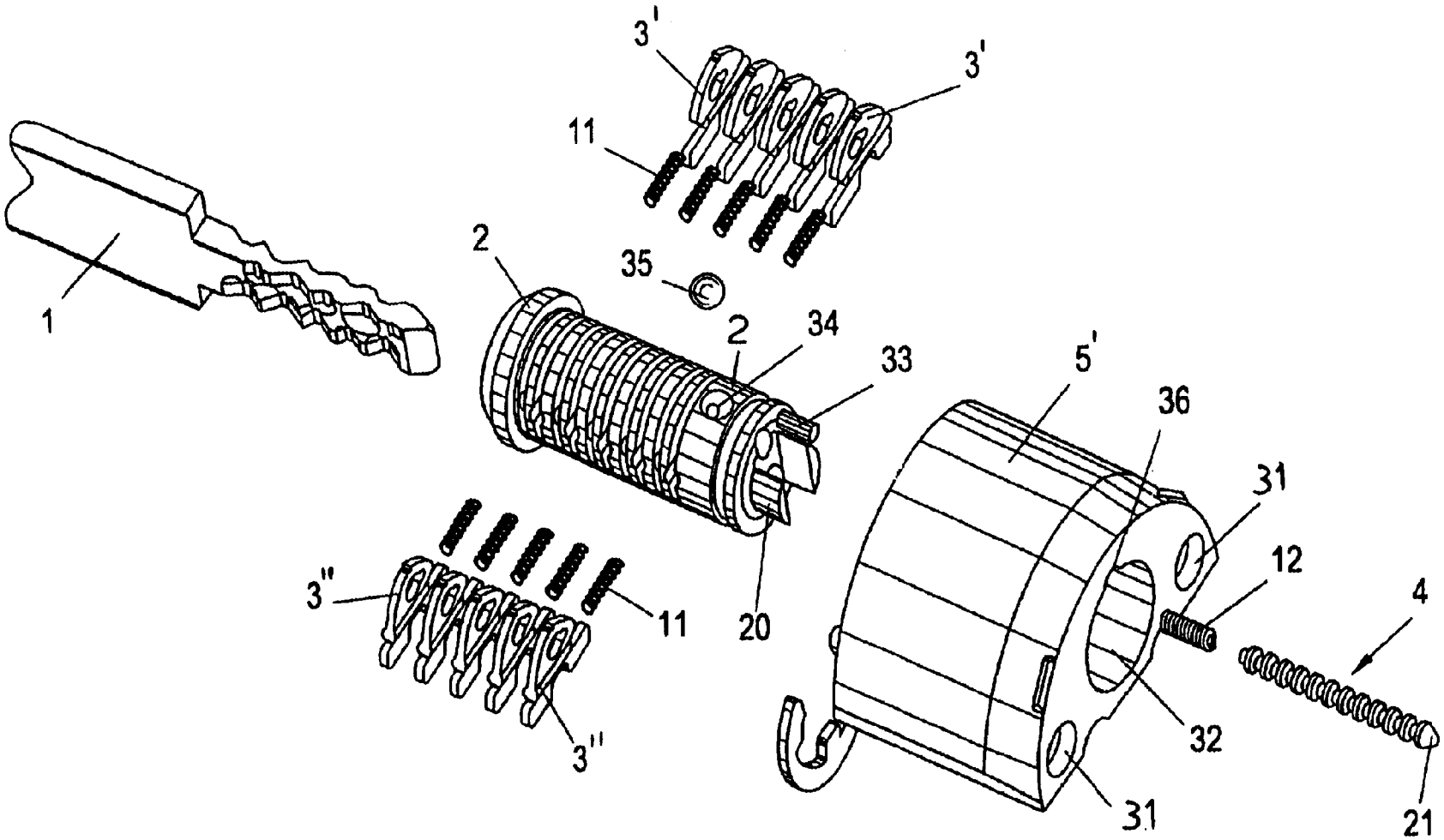
FIG. 9 is an exploded view of another lock in accordance with the invention.
Figure 10:
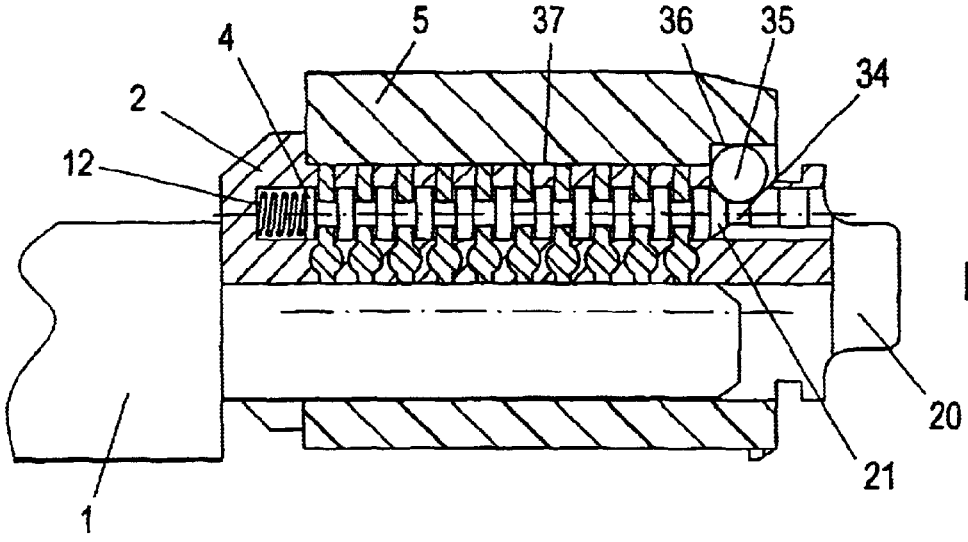
FIG. 10 is an axial section through the FIG. 9 lock.
Figure 11:
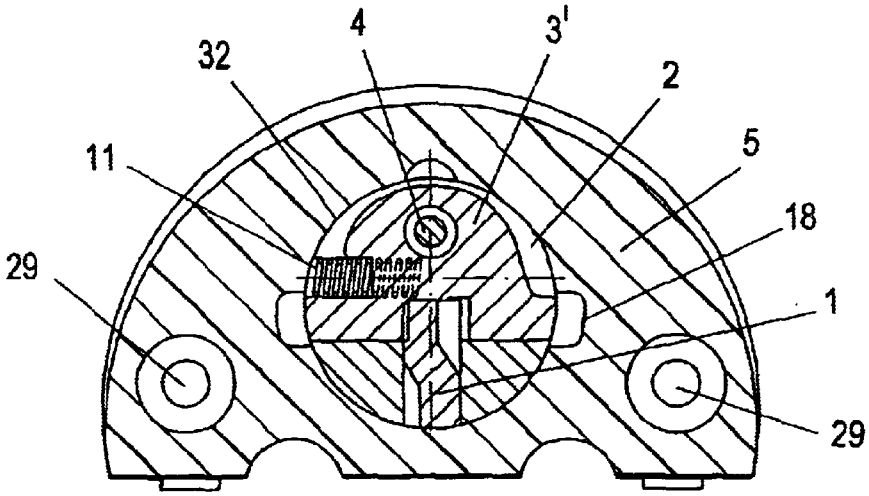
FIGS. 11 and 12 are sections of the FIG. 9 lock in the unlocked and locked positions, respectively.
Figure 12:
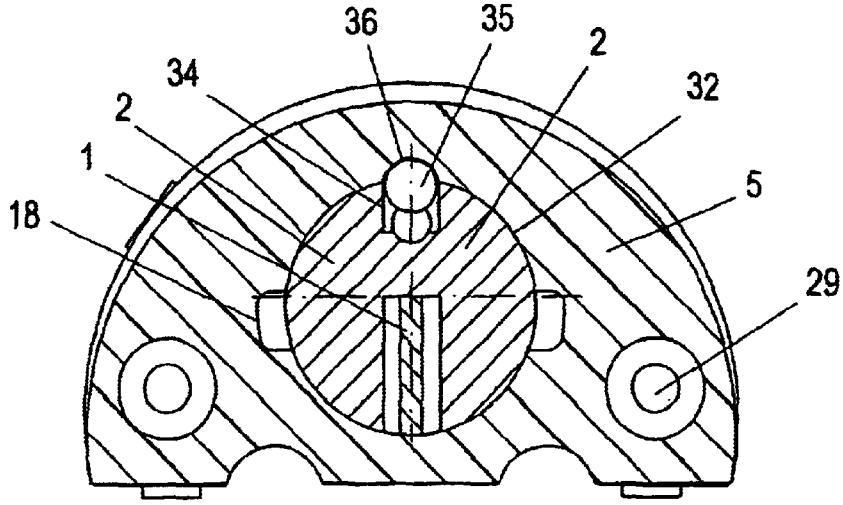

In FIGS. 7 and 8 the tumbler plates 3 are pivotal about axes 19 and provided to the respective side of the plane P, that is with five tumblers 3" to each side of this plane P. Here the core 2 is formed with two identical bores 30 symmetrically flanking the plane P and holding respective bolts 4. Thus this system has two such bolts 4 for added security.

In the arrangement of FIGS. 9 through 12, the key 1 and tumbler plates 3 are substantially identical to those described above. Here, however, the housing body 5' is of semicircular section and formed with a pair of axially throughgoing mounting holes 31. It is made of a hard plastic.

The lock pin 4 here does not project from the rear end of the core 2. Instead it projects into a radially outwardly open blind bore 34 that is aligned in the locked position of the device with a radially inwardly open seat 36 formed in the inside wall of the bore 32 receiving the core 2. A hard metal ball 35 can move radially in the bore 34 between an inner freeing position within the outline of an outer surface of the core 2 and an outer position projecting therepast into the seat 36. In this outer position the ball 35 effectively prevents rotation of the core 2 in the housing 5.

Thus with this arrangement the ball 35 serves as the primary blocking element. It is made of metal so that it can withstand considerable stress, even when mounted in a plastic housing 5'. Otherwise the arrangement functions like those of FIGS. 1 through 8.

We claim:

1. A lock comprising:

a stationary cylinder housing formed with a seat;

a core rotatable about an axis in the housing and formed with an axially extending key passage, a plurality of transverse guide slots, and an axially extending bore;

a bolt axially displaceable in the bore between a locked position and a retracted unlocked position and having a plurality of radially open grooves aligned transversely with the slots in the locked position of the bolt, the core being rotationally fixed in the housing when the bolt is in the locked position;

means coupled to the bolt for engaging in the seat of the housing when the bolt is in the locked position for arresting the core in the housing;

respective tumbler plates transversely displaceable in the slots and each formed with a control edge exposed in the passage and a hole alignable with the bore in a freeing position of the respective plate, each plate being displaceable from the freeing position to a blocking position with its hole offset at least partially from the bore and engaging in the respective groove to block axial movement of the bolt from the locked position; and a key having a plurality of respective bit notches engageable with the control edges on axial engagement of the key in the passage, the control edges and the respective bit notches being positioned such that when the key is fully inserted in the passage all the plates are in the freeing position and the bolt can shift axially between its locked and unlocked positions.

2. The cylinder lock defined in claim 1 wherein the bolt has an inner end forming the means and projecting from the core in the locked position, the housing being formed with a seat complementarily engaging the inner end in the locked position.

3. The cylinder lock defined in claim 1 wherein the means includes a ball engaging an inner end of the bolt and radially displaceable between an outer position engaging in the seat and an inner position clear of the seat.

4. The cylinder lock defined in claim 1 wherein the housing is formed with a radially inwardly open seat and each plate is formed with a radially outwardly projecting tab engaged in the seat in the blocking position.

5. The cylinder lock defined in claim 1 wherein each plate is formed with a guide formation engaging a complementary guide formation of the respective slot for transverse sliding of the plates between the freeing and blocking positions.

6. The cylinder lock defined in claim 1 further comprising pivot means for pivoting of the plates between the freeing and blocking positions.

7. The cylinder lock defined in claim 1, further comprising respective springs urging the plates into the blocking position and urging the control edges toward the passage and, when a key is therein, into engagement with the key.

8. The cylinder lock defined in claim 1 wherein the bit notches end generally at a symmetry plane of the key.

9. The cylinder lock defined in claim 1 wherein the bit notches have flanks forming acute angles with the respective faces of the key, whereby the control edges can slide down into and up out of the notches as the key is inserted in the passage.

10. The cylinder lock defined in claim 1 wherein the key has a pointed front end cammingly engageable with the control edges on insertion of the key into the passage.

11. The cylinder lock defined in claim 1 wherein the notches are provided in two sets staggered on opposite faces of the key.

12. The cylinder lock defined in claim 1 wherein the key is symmetrical to a plane and formed with two identical sets of notches for use of the key upside down.

* * * * *